US009883560B2

(12) United States Patent
Garner

(10) Patent No.: US 9,883,560 B2
(45) Date of Patent: Jan. 30, 2018

(54) CONTROLLER FOR A PHASE CUT DIMMABLE LED DRIVER

(71) Applicant: Richard Garner, Arlington, MA (US)

(72) Inventor: Richard Garner, Arlington, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 188 days.

(21) Appl. No.: 14/865,069

(22) Filed: Sep. 25, 2015

(65) Prior Publication Data

US 2017/0094738 A1 Mar. 30, 2017

(51) Int. Cl.

| | |
|---|---|
| ***H05B 33/08*** | (2006.01) |
| ***H05B 37/02*** | (2006.01) |
| ***H05B 39/08*** | (2006.01) |
| ***H05B 41/14*** | (2006.01) |
| ***H05B 41/282*** | (2006.01) |
| ***H05B 41/392*** | (2006.01) |
| ***H05B 39/04*** | (2006.01) |

(52) U.S. Cl.

CPC ..... *H05B 33/0845* (2013.01); *H05B 39/04* (2013.01)

(58) Field of Classification Search

CPC ..... H05B 33/0815; H05B 33/0818; H05B 33/0845; H05B 33/0851; H05B 37/0263; H05B 37/0272; H05B 37/0218; H05B 37/0227; H05B 39/08; H05B 37/0209; H05B 37/0254; H05B 41/14; H05B 41/2828; H05B 41/392

See application file for complete search history.

(56) References Cited

U.S. PATENT DOCUMENTS 5,504,395 A * 4/1996 Johnson ..... H01K 1/62 307/157
5,583,402 A * 12/1996 Moisin ..... H05B 41/3927 315/207
2015/0156842 A1 6/2015 Miyahara et al.

FOREIGN PATENT DOCUMENTS

EP 2603062 A1 6/2013
JP H1132485 A 2/1999

OTHER PUBLICATIONS

Maicas, Jesus, International Search Report and Written Opinion of the International Searching Authority, for counterpart application PCT/US2016/052549, Dec. 12, 2016, European Patent Office, Rijswijk, The Netherlands, (13 pages).

(Continued)

*Primary Examiner* — Dedei K Hammond
(74) *Attorney, Agent, or Firm* — Yutian Ling

(57) ABSTRACT

A control scheme for a dimmable lighting driver is provided. The control scheme may operate with a phase cut type dimmer (leading or trailing edge). In an embodiment, the control scheme is programmed or otherwise configured into a controller as a control algorithm. The control algorithm is configured to measure phase cut and zero crossing angles of the input mains waveform, and to subsequently maintain constant LED current commensurate with a user-set dimming level, with no flicker. The control algorithm may be implemented in software, such as a firmware-based routine executable by one or more controllers of a given driver. The one or more controllers may be, for example, an existing general purpose controller of the given driver, or a dedicated dimming controller. Numerous configurations will be apparent in light of this disclosure.

27 Claims, 11 Drawing Sheets

(56) References Cited

OTHER PUBLICATIONS

English Abstract of JP H1132485 obtained by European Patent Office (1 page).

* cited by examiner

CONTROLLER FOR A PHASE CUT DIMMABLE LED DRIVER

FIELD OF THE DISCLOSURE

The present application relates to lighting systems, and more specifically to controllers for phase cut dimmable light emitting diode (LED) drivers.

BACKGROUND

A particular challenge with regard to LED lamp drivers is in designing them for dimming operation when used with the most common type of dimmer present in the existing infrastructures of the world today, namely, the phase cut dimmer. As is known, a phase cut dimmer effectively cuts off a portion of each cycle of the alternating current from the main voltage supply, typically referred to as the mains. Therefore, it is necessary that dimmable LED drivers be designed to perform well with such dimmers. Perhaps the most important aspect of performing well, from the user point-of-view, is that the resulting light from an LED lamp does not flicker. Thus, the dimmable LED driver must perform its basic functionality (converting power from the mains to voltages and currents suitable for powering one or more strings of LEDs) with the likely possibility that the mains alternating waveform may be zero for a fraction of its cycle due to a user call for dimming, and where the fraction can vary as the dimming level is varied by the user. The dimming level is established through adjustment of the phase cut angle, which is the phase angle in the mains cycle at which the waveform turns on (leading edge dimmer, sometimes referred to as forward phase control) or turns off (trailing edge dimmer, sometimes referred to as reverse phase control). Compounding the design challenge is that the mains waveform has noise and, possibly, distortions, fluctuations, amplitude drifts, or other non-ideal characteristics that are difficult to predict. Further compounding this challenge is that there are numerous dimmers available from various third party manufacturers, and the dimmable LED driver should work with all of them. Designing such a driver is not a trivial task. For instance, while many of the dimmer circuits have the same generic design, from an electronics perspective, they differ substantially in construction, component layout, specific component values, and so on. All of these can have an impact on the behavior of the LED driver, and therefore the behavior of the light output from the lamp. In general, current dimmable LED drivers may seemingly perform well. However, there are situations, difficult to predict, for which this is not the case.

DETAILED DESCRIPTION

Figure 1:
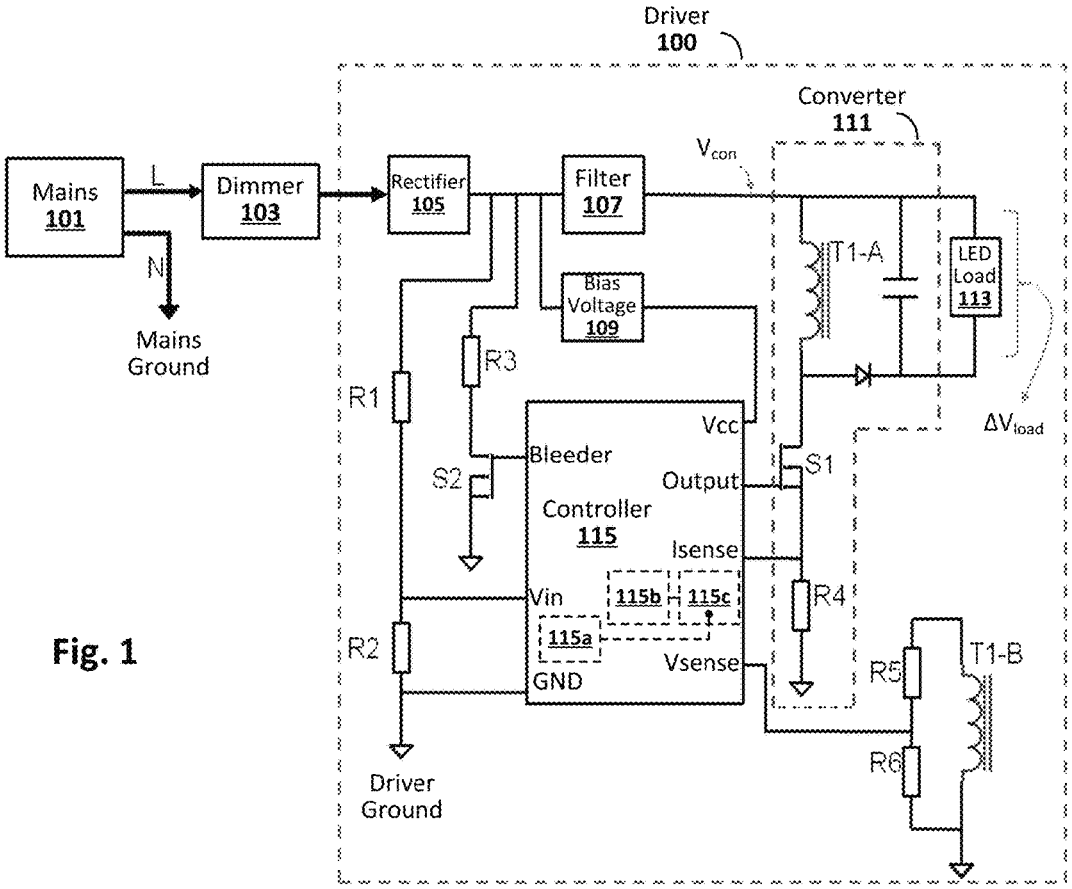
FIG. 1 illustrates a block diagram of a lighting driver circuit including an embedded controller that is programmed with a control algorithm configured in accordance with an embodiment of the present disclosure.

A control scheme for a dimmable lighting driver is provided. The lighting system may be, for instance, LED-based, but need not be, as the techniques provided herein can work with any number of light sources. The control scheme may operate with a phase cut type dimmer (leading or trailing edge). In an embodiment, the control scheme is programmed or otherwise configured into a controller as a control algorithm. The control algorithm is configured to measure phase cut and zero crossing angles of the input mains waveform, and to subsequently maintain constant LED current commensurate with a user-set dimming level, with no flicker. The control algorithm may be implemented in software, such as a firmware-based routine executable by one or more controllers of a given driver. The one or more controllers may be, for example, an existing general purpose controller of the given driver, or a dedicated dimming controller. Numerous configurations will be apparent in light of this disclosure.

General Overview

As previously noted, there are a number of situations where current dimmable LED drivers fail to perform well, and it is not always easy to predict the various situations where poor performance may arise. Many of the problems underlying the poor performance stem from non-ideal characteristics of the real-world mains waveform, such as those mentioned above. These lead to errors by the control algorithms employed by the drivers (typically in separate control sections of the driver), regardless of whether these algorithms are analog or digital (software) based. In more detail, a typical dimmable LED driver contains a basic switch-mode converter that converts an input voltage into output required for the LED string, plus a controller which operates in a feedback loop relative to the converter. The input voltage may come from a prior stage of the driver, which may simply be a full wave rectifier plus a large capacitor to make the waveform approximately constant. In other cases, the input stage may be more complicated, performing additional filtering and possibly power factor correction. In any case, the controller typically monitors the input voltage to the driver and may further monitor the input voltage and current to the LEDs, and subsequently establishes the required LED current associated with the desired dim level. In particular, the light controller ensures that such current is, on average, constant, and, furthermore, that enough total current flows through the lamp (and therefore the dimmer), so that the dimmer does not turn off at undesirable times in the phase, especially if such turn-offs occur sporadically from cycle-to-cycle. Leading edge TRIAC-based dimmers in particular are susceptible to this condition, since a TRIAC has a so-called holding current, which refers to the minimum current through the TRIAC below which the TRIAC stops conducting. Many LED drivers employ an integrated circuit (IC) for control, and many manufacturers make such ICs. The ICs contain the typical algorithms, which may be analog or digital (software-based). These algorithms contain the various typical decision-making processes. They acquire the appropriate data from within the driver and, based on subsequent analysis of this data, send output signals for proper control. For dimmable LED drivers operating with phase cut dimmers, there two primary aspects of control: 1) ensuring that LED current is commensurate with dimmer level (or phase cut angle) set by the user; and 2) ensuring that lamp current (same as dimmer current) is such that it does not lead to undesirable turn-off of the dimmer. The first is tantamount to "knowing" the phase cut angle. Many controllers determine this simply by cycle averaging the phase cut waveform (suitably transformed for the purposes of acquiring the data, such as full wave rectifying, voltage dividing, and averaging). This is fairly straightforward and typically does not lead to problems. The second aspect is more problematic, particularly when there is significant noise, fluctuations, and/or distortions on the mains waveform. The lamp current is low during the phase cut (zero) portion of the waveform, and also during the non-zero portion of the waveform during the time the waveform approaches its normal (non-phase cut) zero-crossing. For these situations the driver is designed to pull extra current which does not go through the LEDs, but is simply shunted to the circuit ground. Sometimes the circuit is referred to as a bleeder circuit if it is external to the controller IC and in parallel with the converter circuit. Otherwise, it may be internal to the controller, but the functionality is similar. In any case, in order for the controller to perform this function properly, it must determine the actual times during which this extra current is needed. In effect it must "know" the absolute phase of the phase cut waveform. Many algorithms determine this in a local sense with respect time. An example would be a thresholding technique, whereby the current is designated as too low if the acquired input waveform goes below some level. Such techniques are very sensitive to noise, fluctuations and distortions, especially if the latter occur in the vicinity of the threshold. Such local techniques are most likely augmented by, for example, low pass filtering and/or fitting, but what may work well for particular distortions/fluctuations, may work poorly for others. Thus, a robust control algorithm should be configured to consider the problem of phase detection through a non-local (in time) view of the waveform.

Thus, and in accordance with an embodiment of the present disclosure, lighting driver control techniques are provided which are immune to many, if not all, of the potential problems encountered with the mains waveform. In some embodiments, the control algorithm is incorporated into a dimmable LED driver, although other dimmable lighting drivers may benefit from the disclosed techniques as well. The control algorithm is programmed or otherwise configured to determine certain characteristics of phase cut waveforms, including the phase cut angle and zero crossing angle. The control algorithm may be implemented with software and in one such embodiment, is part of the firmware of a digital-type controller (e.g., a microcontroller, or application specific integrated circuit or so-called ASIC). The dimming control algorithm (and its associated controller) may be included in a general purpose lighting controller, but may also be deployed as a dedicated dimming control scheme that is used in conjunction with one or more other, separate controllers that handle other aspects of the control functionality. In still other embodiments, the control algorithm may be implemented in hardware using, for example, gate level logic or purpose built semiconductor (e.g., field programmable gate array, or so-called FPGA) configured to execute the same functionality as a software-based embodiment. The techniques can be employed in any number of power supply topologies having a constant-current output stage, whether isolated or non-isolated, such as boost converter, buck converter, buck-boost or so-called flyback converter, ringing choke converter, half-forward converter, push-pull converter, half-bridge and full-bridge converter, resonant converter, and Ćuk converter topologies. The conversion may be, for example, from AC to AC, AC to DC, or AC to DC to DC or some other multi-stage conversion initiated from an AC mains. As will be further appreciated in light of this disclosure, the dimming control techniques provided herein need not be limited to LED or other lighting applications; rather, the techniques may be used with any loads that can operate under a phase cut based process. In a more general sense, the control algorithm can be implemented to work with any number of converter topologies and various electrical parameters.

System Architecture

FIG. 1 illustrates a block diagram of a lighting driver circuit 100 including an embedded controller that is programmed with a control algorithm configured in accordance with an embodiment of the present disclosure. As can be seen, the driver circuit 100 can be operatively coupled to a dimmer circuit 103, which can in turn be connected to a mains supply 101. The driver circuit 100 of this example embodiment is a single-stage, non-isolated buck-boost converter topology, but as previously explained and as will be apparent, other converter topologies can be used, and the driver 101 may have more than one stage and may be isolated. As can be further seen, the driver circuit 100 is connected to an LED-based load 113 and includes a rectifier 105, a filter 107, a bias voltage module 109, a converter 111, and a controller 115.

The mains 101 can be any suitable AC source, such as a typical 120 VAC, 60 Hertz power source. The dimmer 103 may be inline (in series with the driver/lamp, as shown), or it may have access to N output of the mains. It may be implemented with any suitable phase cut dimmer circuit. Note that dimmer 103 may be a forward or reverse phase cut dimmer, and the techniques provided herein work equally well with either such dimmer type. The rectifier 105 receives the AC output of the dimmer 103 and converts it to a fully rectified signal. The rectified output is then filtered and adjusted by filter 107 as necessary to, for example, remove AC ripple on the voltage ($V_{con}$) subsequently powering the converter 111. Note this AC ripple (fluctuations at the mains 101 frequency) is not to be confused with PWM ripple (higher frequency fluctuations at the pulse width modulation frequency of the driver 100. Such PWM ripple can be filtered, for example, by the capacitor across the LED load 113. Further note that $V_{con}$, in this example single stage case, is roughly DC with a value near that of the amplitude of the mains (e.g., 120V×sqrt(2)), as a result of the full-wave rectification process. The converter then shifts from the nominal DC input $V_{con}$ to the voltage necessary for the load 113 (e.g., an LED string specified for ~24-28V, or whatever voltage the given load calls for). In a two-stage driver, there might be, for instance, a first stage that converts first to some intermediate voltage, followed a second stage. The techniques provided herein can be used with any such configurations, as will be appreciated in light of this disclosure. Bias voltage module 109 also receives the rectified output of the rectifier 105 and generates a local DC bias (Vcc) that can be used to power the various components within the driver 100, such as the microcontroller 115. A typical Vcc value is about 3.3 Volts DC, although any number of bias voltages can be provisioned depending on the needs of the given componentry.

In this example case, the controller 115 is a microcontroller that is programmed with a controller algorithm 115*a* and further includes various inputs and outputs. The microcontroller may be, for instance, a general purpose microcontroller that is programmable or otherwise configurable, or a purpose-built controller specifically designed for lighting applications or even more specifically for a particular lighting application (e.g., controller for phase cut dimmer applications). In a more general sense, controller 115 can be any computing environment that is configurable and has input/output (I/O) and processing capability sufficient to execute a control scheme as provided herein. Note the controller 115 may include various componentry and modules therein, such as processor(s) 115*b* capable of executing firmware and other instructions 115*a*, analog-to-digital converter(s), counter(s), timer(s), and other such functional circuits, as well as memory 115*c* (e.g., volatile and non-volatile). As shown, controller algorithm 115*a* can be stored in memory 115*c* (e.g., DRAM or EPROM or some other non-transitory machine readable memory), and is accessible for execution by processor 115*b*.

With further reference to the example embodiment of FIG. 1, three inputs are used, including Vin, Isense, and Vsense. Each of these analog inputs can be converted to the corresponding digital equivalent by an analog-to-digital converter (ADC) within the controller 115. Vin is a voltage divided copy of the full wave rectified input voltage. The values of resistors R1 and R2 are chosen such that Vin is within the dynamic range of the ADC. Isense is a measure of the current through the LED load 113. It is equal to the value of resistor R4 multiplied by the current through the inductor T1-A of the converter 111, when the switch S1 is closed. The current that is charged up in inductor T1-A when switch S1 is closed flows through the LED load 113 when switch S1 is open. In some embodiments, a low pass filter may be provided in-line with Isense, which serves to average the voltage. Vsense is a measure of the voltage across the LED load.

As can be further seen, the controller 115 utilizes two pulse width modulated (PWM) outputs, labeled Output and Bleeder in FIG. 1. The Output signal generated by controller 115 controls the switch S1 and therefore essentially controls the current through the LEDs 113. The Bleeder signal generated by controller 115 controls the switch S2 that, when closed, causes current to flow through resistor R3. At the proper times (when average LED current is too low) the controller directs the Bleeder output to close switch S2 to ensure that the dimmer current does not go below its holding current (and thereby go into a non-conducting state). Note that reference here to the average current being low is not to be confused with instances during times when the PWM switch is closed when instantaneous current may go low. Further note that switches S1 and S2 are shown as field effect transistors (FETs), but any suitable switching circuitry can be used.

Figure 2:
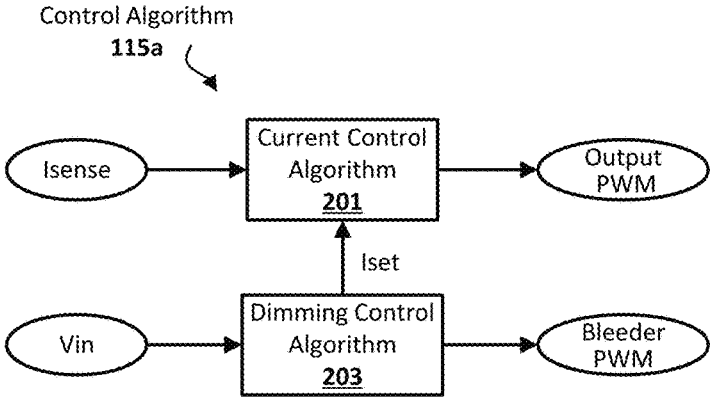
FIG. 2 illustrates a block diagram of a control algorithm configured in accordance with an embodiment of the present disclosure.

A block diagram of the control algorithm 115*a* (firmware) that runs in the controller 115 is shown in FIG. 2, according to one example embodiment. As can be seen, the control algorithm 115*a* includes two main parts: the current control algorithm 201 and the dimming control algorithm 203. The current control algorithm 201 can be implemented with any commercially available or custom current control algorithm. As will be appreciated, the techniques provided herein can be used in conduction with any suitable current control algorithms 203. The dimming control algorithm 203, on the other hand, can be programmed or otherwise configured in accordance with an embodiment of the present disclosure to provide very robust dimming performance.

As can be further seen in FIG. 2, the control algorithm 115*a* has the two main tasks of deciding the duty cycles of the two PWM signals to be output by the controller 115 (Output and Bleeder), based on the measurements of Vin and Isense. The current control algorithm 201 works to keep Isense constant on average, at the level Iset, by adjusting the Output PWM which drives switch S1 of the converter 111. The dimming control algorithm 203 is configured to carry out two main decisions: 1) it decides what the constant current, Iset, should be; and 2) it decides when to turn on the Bleeder PWM and what its duty cycle should be. Both of these subparts are based on the Vin signal.

In more detail, and in accordance with one example embodiment, the dimming control algorithm 203 is configured to carry out two main tasks, in addition to any other desired functionality. The first task is to determine the phase cut angle of the dimmer 103, and the second task is to determine the appropriate on and off times of the bleeder circuit (switch S2). The dimming control algorithm 203 carries out these two tasks utilizing the information available to it, namely Vin. The first task allows for establishment of the current control PWM duty cycle, since the phase cut angle is essentially an indicator of the desired LED current/light output. The second task allows for establishment of the appropriate on and off times of the bleeder control PWM output, ensuring that the dimmer does not turn off. The challenge for the dimming control algorithm 203 is that the Vin signal is acquired with no a priori information about phase.

Figure 3:
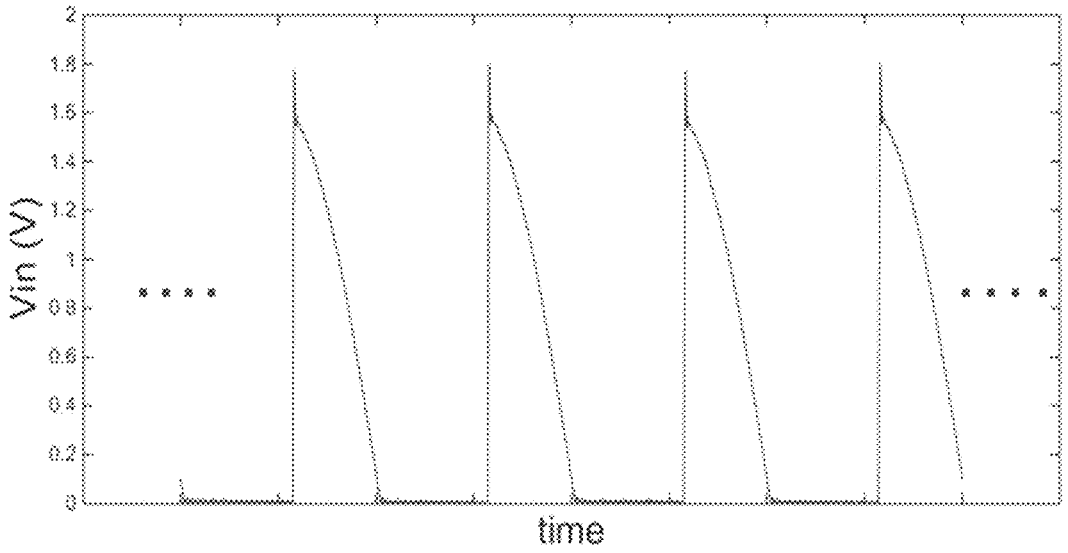
FIG. 3 illustrates a plot of an example Vin signal.

An example Vin signal is shown in FIG. 3. In this example case, a leading edge phase cut dimmer is used for dimmer 103, however the control algorithm 115*a* will work equally well with a trailing edge dimmer. Time units are immaterial here (the control algorithm 115*a* will work on any time scale). The frequency of the Vin waveform may vary as well, but typically will be either 100 Hz or 120 Hz, corresponding to two commonly used mains frequencies (full wave rectified), according to some embodiments. The plot represents a snapshot in time of the mains 101 voltage followed by a leading edge dimmer 103, and subsequently (inside the driver 100) full wave rectified and divided down to the range shown. As will be further appreciated, the voltage range of Vin will vary from one embodiment to the next, depending on factors such as the target application, and the present disclosure is not intended to be so limited. The dimmer's 103 phase cut angle in this example case is set to approximately 110 degrees.

Figure 4A:
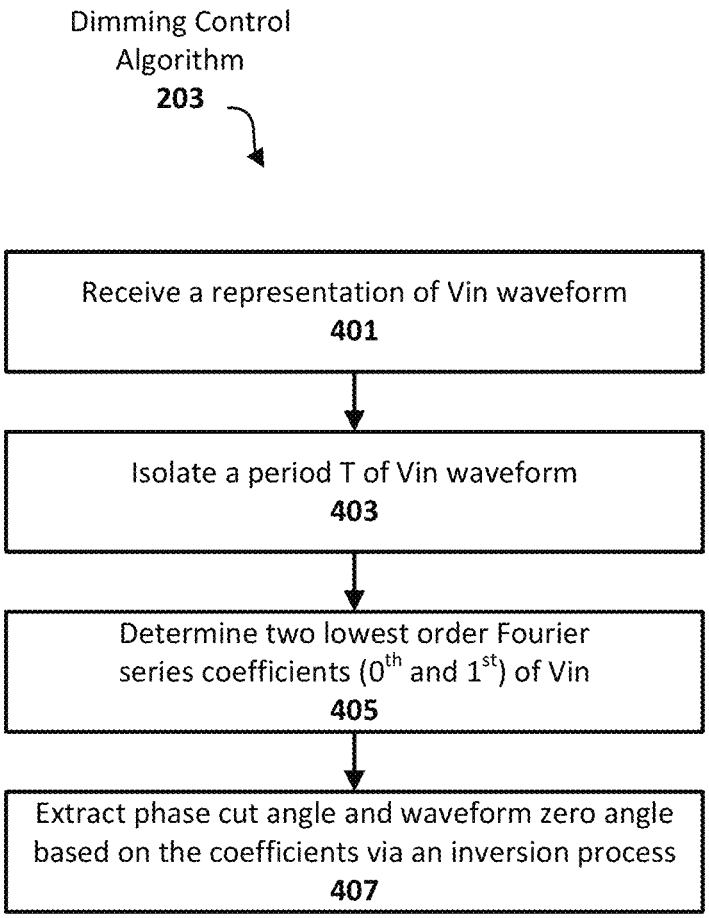
FIGS. 4*a-b* are flow charts collectively illustrating a dimming control methodology configured in accordance with an embodiment of the present disclosure.

The overall mathematical approach of the dimming control algorithm 203 according to one example embodiment is shown in FIG. 4*a*. As can be seen, the methodology includes receiving 401 the Vin waveform, and isolating 403 or otherwise acquiring one period of the Vin waveform. The data representing the acquired signal period can be stored, for example, in a local non-volatile memory. The methodology continues with determining 405 the two lowest order Fourier series coefficients ($0^{th}$ and $1^{st}$) associated with the Vin waveform using that data representing the acquired signal period, and extracting 407 the phase cut angle ($\varphi_{cut}$) and the waveform zero angle ($\varphi_{zero}$) through inversion of an analytical representation of those coefficients. The technique relies on knowledge of the frequency of the mains 101 waveform. Since mains frequencies are typically either 50 Hz or 60 Hz, and since these frequencies are typically very precise and stable, then this knowledge can communicated to the dimming control algorithm 203 by, for example, by a switch setting in the driver (perhaps set at the factory, or by the user during installation or during some other configuration process, whether at an out-of-box installation time or a post-installation retrofit installation time or a software startup program in the controller that runs each time it is turned on). Simulations performed indicate acceptable variations of results due to expected variations (~0.5%) of the mains frequency from the preset frequency.

Figure 5A:
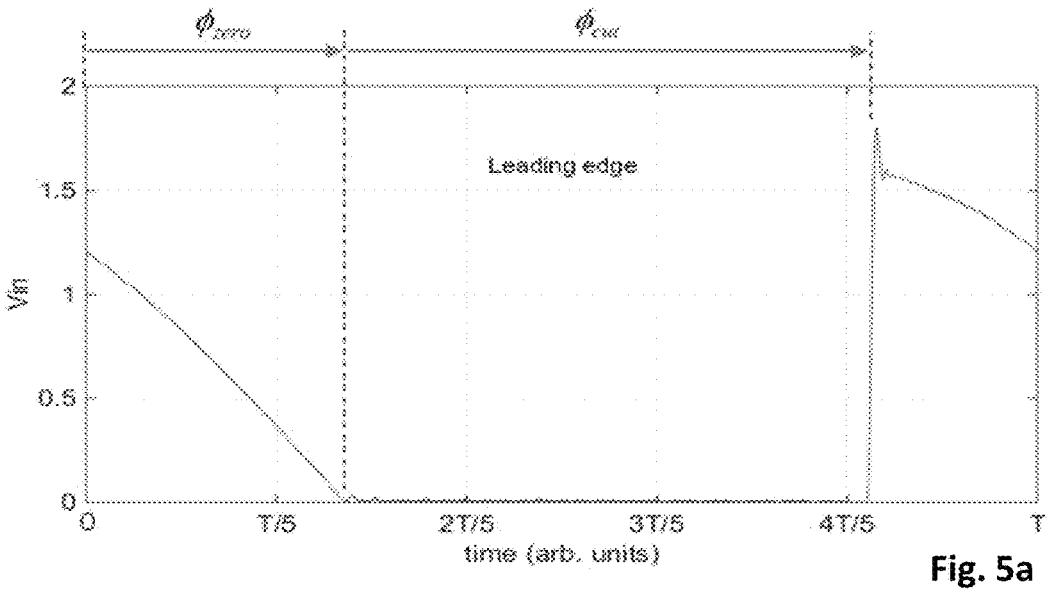
FIGS. 5*a* and 5*b* illustrate example plots of one period of actual measured Vin signals, with FIG. 5*a* depicting a leading edge phase cut Vin signal and FIG. 5*b* depicting a trailing edge phase cut Vin signal.
Figure 5B:
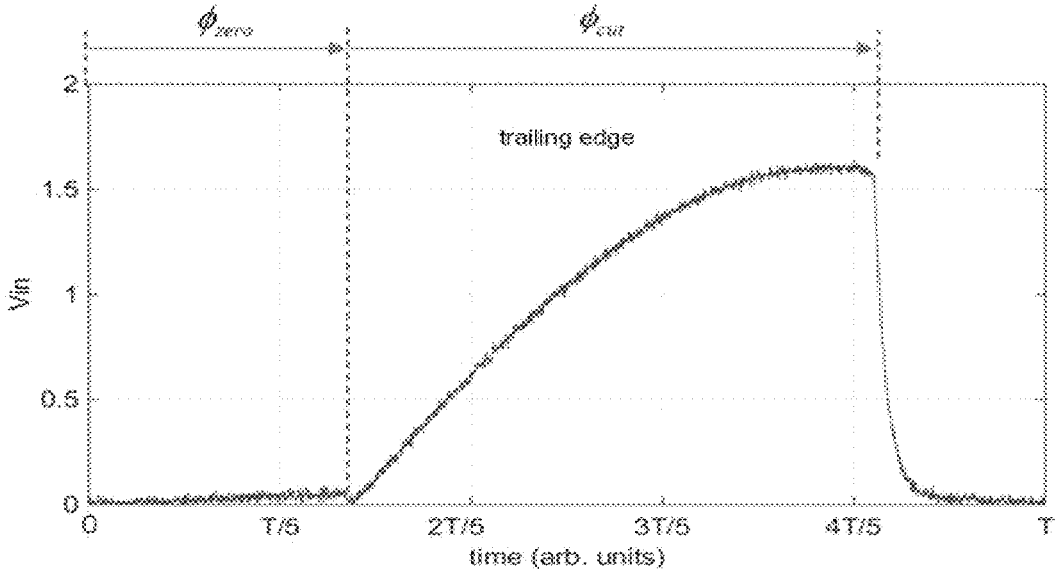

The dimming control algorithm 203 thus considers data that, when plotted, look like that shown in FIGS. 5*a* and 5*b*, which respectively show two examples of one period of Vin. The plot shown in FIG. 5*a* represents a leading edge phase cut waveform, while the plot shown in FIG. 5*b* represents a trailing edge phase cut waveform. The phase of each of these Vin waveforms is arbitrary; as stated, the dimming control algorithm 203 has no (and requires no) a prior information about phase. The time scale is immaterial, so no particular units are assigned to the x axes. It is convenient to consider the value of the period, T, to be equal to $\pi$. In this way the x-axis represents the phase of the waveform in radians. The dimming control algorithm 203 determines the values of $\varphi_{cut}$ and $\varphi_{zero}$, which are indicated the FIGS. 5*a-b*. Note that both of $\varphi_{cut}$ and $\varphi_{zero}$ have the same meaning for leading and trailing edge. The waveform zero angle $\varphi_{zero}$ is the "time" between the x-axis zero and the waveform zero (i.e., the zero of the corresponding non-phase cut waveform). The phase cut angle $\varphi_{cut}$ is the "time" between the waveform zero and the "on" time of the waveform (leading edge), or "off" time of the waveform (trailing edge), as the case may be. Both of these are considered to be in the range of 0 to T, just like the "time" variable. It is further noted that the data depicted in FIGS. 5*a-b* are from actual measurements of Vin and therefore show some of the non-idealities of real-world data (e.g., noise, fluctuations, non-zero turn-on/off times, etc). These are some of the issues with which the dimming control algorithm 203 contends, according to some embodiments.

Once a period of the Vin waveform is acquired, the two lowest order Fourier series coefficients ($0^{th}$ and $1^{st}$) associated with the Vin waveform can be determined. In more detail, assume that the waveforms are, in an ideal sense, represented mathematically as follows, when their phases ($\varphi_{zero}$) are zero:

$$V_{LE}^{o} = \begin{cases} 0, & 0 < \tau < \phi_{cut} \\ A\sin\tau, & \phi_{cut} < \tau > \pi \end{cases} \tag{1}$$

$$V_{TE}^{o} = \begin{cases} A\sin\tau, & 0 < \tau < \phi_{cut} \\ 0, & \phi_{cut} < \tau > \pi \end{cases} \tag{2}$$

where the period T=$\pi$, and therefore the time variable, $\tau$, is in the range of 0 to $\pi$. The variable A is the amplitude, also a priori unknown. When $\varphi_{zero}$ differs from zero, then shift the waveforms forward in time by $\varphi_{zero}$ but with wrap-around from $\pi$ to 0. In this way the variable $\tau$ is replaced with $\tau-\varphi_{zero}$, and the ranges in (1) and (2) can be re-specified accordingly, especially when the zero portion of the waveform straddles $\pi$. This re-specification is presumed when the waveform is in its zero and non-zero states. Thus, keep in mind that the non-zero state of the waveform has the form $A\sin(\tau-\varphi_{zero})$ for any $\varphi_{zero}$.

Now further consider that the measured single-period waveform is repeated for all time, past and future. In this way, the waveform is an infinite, periodic function with period it and therefore can be expressed in terms of a Fourier series. The fact that the considered waveform (one period) is not infinite does not matter because the dimming control algorithm 203 compares the fictitiously infinitely-extended measured waveform with its infinitely-extended analytical representation. Alternatively, it can be said that the Fourier series provides a good representation of the infinitely extended waveform, but the dimming control algorithm 203 is effectively only interested in one period. The comparison is made using the $0^{th}$ and $1^{st}$ order coefficients, according to this example embodiment. Note, however, that one can consider higher order coefficients, which has been done in computer simulations, but it is not necessary to do so for actual implementation.

The Fourier series representation of an infinite periodic function $f(\tau)$ with period $\pi$($\alpha$ propos the present discussion) is:

$$f(\tau) = \frac{a_0}{2} + \sum_{n=1}^{\infty} [a_n\cos(2n\tau) + b_n\sin(2n\tau)] \tag{3}$$

where the Fourier coefficients are $$a_n = \frac{2}{\pi}\int_0^{\pi} f(\tau)\cos(2n\tau)d\tau \tag{4}$$

$$b_n = \frac{2}{\pi}\int_0^{\pi} f(\tau)\sin(2\pi\tau)d\tau \tag{5}$$

for all n≥0. For the infinitely extended versions of the ideal, analytical waveforms in (1), the $0^{th}$ and $1^{st}$ order coefficients have been calculated, and they are as follows:

$$a_0 = \frac{2A}{\pi}[1 \pm \cos(\phi_{cut})] \tag{6}$$

$$a_1^o = \frac{A}{3\pi}[-2 \mp 3\cos(\phi_{cut}) \pm \cos(3\phi_{cut})] \tag{7}$$

$$b_1^o = \frac{A}{3\pi}[\mp 3\sin(\phi_{cut}) \pm \sin(3\phi_{cut})] \tag{8}$$

where the upper signs correspond to leading edge and the lower signs correspond to trailing edge. The superscript '$^o$' indicates that these correspond to the case of $\varphi_{zero}$=0. The coefficient $a_0$ is independent of $\varphi_{zero}$ and therefore has no superscript (it is twice the average of the waveform, which doesn't change as the phase changes).

For the general case of $\varphi_{zero}\neq 0$, expressions for the Fourier coefficients in terms of those for the $\varphi_{zero}$=0 case can be derived by replacing $\tau$ with $\tau-\varphi_{zero}$ in the expressions (4) and (5). After some straightforward algebraic manipulation, the following are obtained:

$$a_1 = a_1^o\cos(2\varphi_{zero}) - b_1^o\sin(2\varphi_{zero}) \tag{9}$$

$$b_1 = a_1^o\sin(2\varphi_{zero}) + b_1^o\cos(2\varphi_{zero}) \tag{10}$$

This is recognized as a rotation in $(a_1,b_1)$ space by an angle of $2\varphi_{zero}$, and therefore the quantity $a_1^2+b_1^2$ is invariant (not a function of $\varphi_{zero}$). In particular, $$a_1^2+b_1^2=(a_1^o)^2+(b_1^o)^2 \tag{11}$$

The three equations (6), (9), and (10), with the appropriate substitutions of (7) and (8), provide analytical expressions for the quantities $a_0$, $a_1$, and $b_1$ in terms of three unknowns: $\varphi_{cut}$, $\varphi_{zero}$ and A. Experimental values for $a_0$, $a_1$, and $b_1$ can be derived from the measurements of the single period of Vin. These are as follows:

$$a_{0M} = \frac{2}{N}\sum_{k=1}^{N} d_k \tag{12}$$

$$a_{1M} = \frac{2}{N}\sum_{i=k}^{N} d_k \cos\left(\frac{2\pi k}{N}\right) \tag{13}$$

$$b_{1M} = \frac{2}{N}\sum_{k=1}^{N} d_k \sin\left(\frac{2\pi k}{N}\right) \tag{14}$$

where $d_k$ is the $k^{th}$ data point (voltage value of Vin) in the period and N is the number of points. The "M" in the subscript indicates "measured" valued. It is noted that, in acquiring data, only the most recent value of $d_k$ needs to be stored, as well as the three running sums of $d_k$, $d_k \cos(2\pi k/N)$, and $d_k \sin(2\pi k/N)$. Values for $\cos(2\pi k/N)$ and $\sin(2\pi k/N)$ for all k=1, . . . ,N are pre-calculated and stored during start-up of the lamp.

Thus, an analytical representation of the two lowest order Fourier series coefficients ($0^{th}$ and $1^{st}$) associated with Vin is provided in quantities $a_0$, $a_1$, and $b_1$. By inserting these quantities into the left-hand-sides of the three equations (6), (9), and (10), one can then invert the equations and obtain the three unknowns ($\varphi_{cut}$, $\varphi_{zero}$ and A) corresponding to the particular measured period of Vin, thereby allowing for extraction of $\varphi_{cut}$ and $\varphi_{zero}$ as indicated at 407. One can then use those values of $\varphi_{cut}$ and $\varphi_{zero}$ for control of the driver 100 during subsequent periods of Vin. This version of the dimming control algorithm 203 is generally referred to herein as the full-inversion approach, and the underlying mathematical methodology is further described in more detail below in the section labeled, Mathematical Principles of the Full-Inversion Approach.

A variation of the full-inversion approach may be used to provide for better performance, as further indicated by computer simulations. In this example case, the same three equations (6), (9), and (10) are still utilized together with the experimental values $a_{0M}$, $a_{1m}$, and $b_{1M}$. However, instead of inverting all three equations simultaneously, knowledge of amplitude A is presumed, and a value for $\varphi_{cut}$ can then be obtained from the $a_0$ equation (6). That value of $\varphi_{cut}$ is then inserted into equations (9) and (10) to obtain $\varphi_{zero}$. In one such embodiment, a value of A is assumed based on the nominal RMS (root mean square) level of mains 101 together with the division factor based on the resistance values of the resistors used in the voltage divider to create Vin (e.g., R1 and R2 in the example embodiment of FIG. 1). Although the nominal mains voltage level is used, the performance of the dimming control algorithm 203 does not suffer even if the actual level differs by ±10% from the nominal. This variation of the dimming control algorithm 203 as the "reduced-inversion" approach.

In some cases, an advantage of using the reduced-inversion approach instead of full-inversion approach is that the full-inversion approach may be somewhat noisier than the reduced inversion approach (greater variations of $\varphi_{cut}$ and $\varphi_{zero}$ with respect to the same variations in parameters of the Vin signal, as suggested by computer simulations). Nonetheless, the full-inversion approach may be useful in a hybrid scheme (using both reduced- and full-versions), or for error checking purposes.

Inversion Process

Figure 4B:
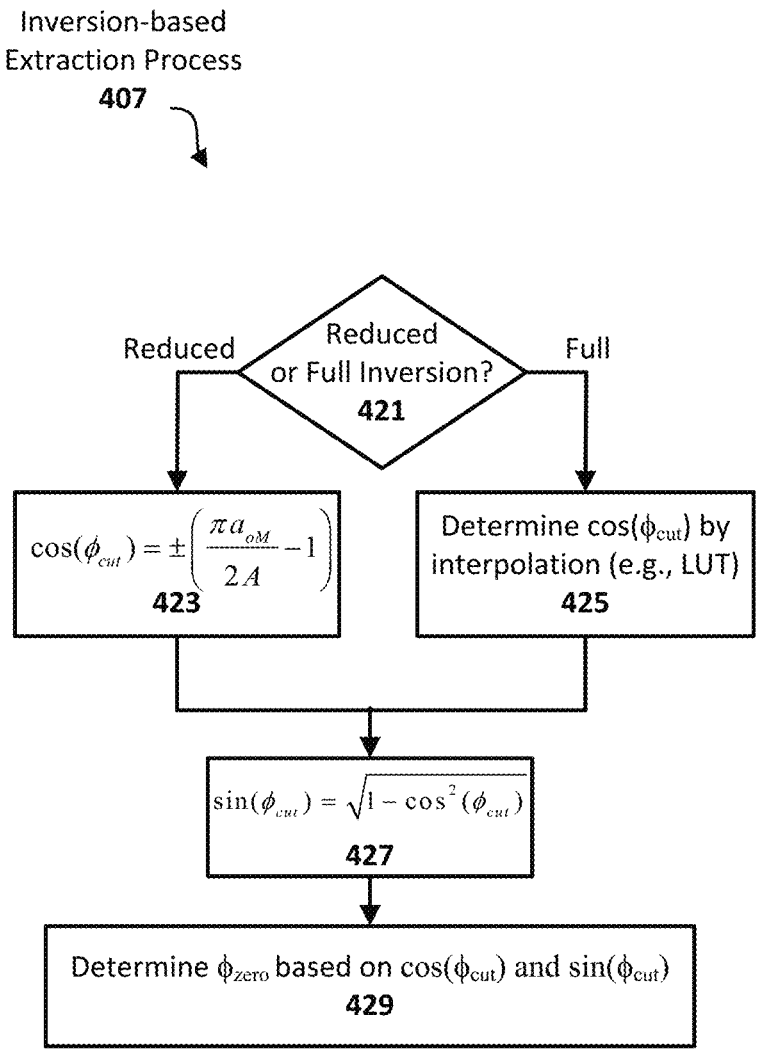

As previously explained at 407 of FIG. 4*a*, the phase cut angle ($\varphi_{cut}$) and the waveform zero angle ($\varphi_{zero}$) can be determined through inversion of the analytical representation ($a_0$, $a_1$, and $b_1$) of the two lowest order Fourier series coefficients ($0^{th}$ and $1^{st}$) associated with Vin. The mathematical procedure of inversion carried out at 407 according to an example embodiment is illustrated in FIG. 4*b*. The methodology generally includes: (1) determine the values of cos ($\varphi_{cut}$) and $\sin(\varphi_{cut})$; and (2) determine the value of $\varphi_{zero}$, according to some embodiments. These two main steps can be used for both the full- and reduced-inversion approach. However, $\cos(\varphi_{cut})$ is determined differently by the two approaches. Hence, the methodology includes a determination at 421 as to whether the full- or reduced-inversion approach is desired. This determination can be based, for example, on a configuration or switch setting set at set-up time. Alternatively, the selection or full- or reduced-inversion approach can be hard-coded, for example, in firmware of the controller 115. Other such arrangements will be apparent in light of this disclosure. In any case, the methodology "knows" or is otherwise informed as to which approach to use, whether because the desired approach is user-specified, hard-coded, or otherwise communicated. As can be seen at 423 of FIG. 4*b*, if the reduced-inversion approach is selected or otherwise desired, $\cos(\varphi_{cut})$ is found from the solution of Equation (6), also shown here:

$$\cos(\phi_{cut}) = \pm\left(\frac{\pi a_{oM}}{2A} - 1\right) \tag{15}$$

Note that the upper sign corresponds to leading edge phase cut waveforms and lower sign to trailing edge phase cut waveforms. On the other hand, and as can be seen at 425 of FIG. 4*b*, if the full-inversion approach is selected or otherwise desired, a nonlinear, implicit function of $\cos(\varphi_{cut})$ can be found (with the other two unknowns eliminated, as will be explained in turn) and $\cos(\varphi_{cut})$ is determined through interpolation with a pre-computed look-up table (LUT). It is noted that determining $\cos(\varphi_{cut})$, instead of just $\varphi_{cut}$, provides for better numerical, and therefore noise, performance over the entire range of $\varphi_{cut}$. The interpolation based process for determining $\cos(\varphi_{cut})$ for the full-inversion approach will be explained in more detail below (under the section header, "Determining $\cos(\varphi_{cut})$ for the Full-Inversion Approach"). After determining $\cos(\varphi_{cut})$, the methodology continues, at 427 of FIG. 4*b*, with determining $\sin(\varphi_{cut})$ follows immediately:

$$\sin(\varphi_{cut})=\sqrt{1-\cos^2(\varphi_{cut})} \tag{16}$$

Next, $\varphi_{zero}$ is determined, at 423. This can be done in the same way by both the full- and reduced-inversion approaches. The values of $\cos(\varphi_{cut})$ and $\sin(\varphi_{cut})$ determined at 421 are inserted into Equations (9) and (10) (more precisely, they are inserted into the expressions for $a_1^o$ and $b_1^o$ in (7) and (8) which are in turn inserted into (9) and (10)). It is noted that the $\cos(3\varphi_{cut})$ and $\sin(3\varphi_{cut})$ that appear in (7) and (8) can both be written in terms of $\cos(\varphi_{cut})$ and $\sin(\varphi_{cut})$ as follows:

$$\cos(3\varphi_{cut})=\cos^3(\varphi_{cut})-3\cos(\varphi_{cut})\sin^2(\varphi_{cut}) \tag{17}$$

$$\sin(3\varphi_{cut})=-\sin^3(\varphi_{cut})+3\cos^2(\varphi_{cut})\sin(\varphi_{cut}) \tag{18}$$

Equations (9) and (10) then have the following form:

$$\begin{pmatrix} a_1^o & -b_1^o \\ b_1^o & a_1^o \end{pmatrix}\begin{pmatrix} \cos(2\phi_{zero}) \\ \sin(2\phi_{zero}) \end{pmatrix}=\begin{pmatrix} a_{1M} \\ b_{1M} \end{pmatrix} \tag{19}$$

This is a standard system of two linear equations in the unknowns $\cos(2\varphi_{zero})$ and $\sin(2\varphi_{zero})$ Coefficients in the matrix on the left-hand-side are known (functions of the known values of $\cos(\varphi_{cut})$ and $\sin(\varphi_{cut})$), as are the values of the terms on the right-hand-side (experimentally determined). Note that the unknowns are considered as $\cos(2\varphi_{zero})$ and $\sin(2\varphi_{zero})$, rather than just $\varphi_{zero}$, otherwise there is an ambiguity about the proper branch of $\varphi_{zero}$. For purposes of this disclosure, assume $\varphi_{zero}$ is on the branch defined by the range of 0 to $\pi$. In solving (19) for $\cos(2\varphi_{zero})$ and $\sin(2\varphi_{zero})$, a value of $2\varphi_{zero}$ in the range of 0 to $2\pi$ is obtained, with its quadrant unambiguously determined by the signs of the cosine and sine values. One then obtains the value of $\varphi_{zero}$ (in the proper branch) by dividing $2\varphi_{zero}$ by 2.

The solution of Equation (19) is $$\cos(2\phi_{zero})=\frac{a_{1M}a_1^o+b_1^o b_{1M}}{(a_1^o)^2+(b_1^o)^2} \tag{20}$$

$$\sin(2\phi_{zero})=\frac{b_{1M}a_1^o+b_1^o a_{1M}}{(a_1^o)^2+(b_1^o)^2} \tag{21}$$

The value of zero is $2\varphi_{zero}$ determined by the "a tan 2" function, a standard function in many compilers:

$$2\varphi_{zero}a\tan 2(\cos(2\varphi_{zero}),\sin(2\varphi_{zero})) \tag{22}$$

which provides the proper quadrant for $2\varphi_{zero}$ Finally:

$$\phi_{zero}=\frac{2\phi_{zero}}{2} \tag{23}$$

Figure 6:
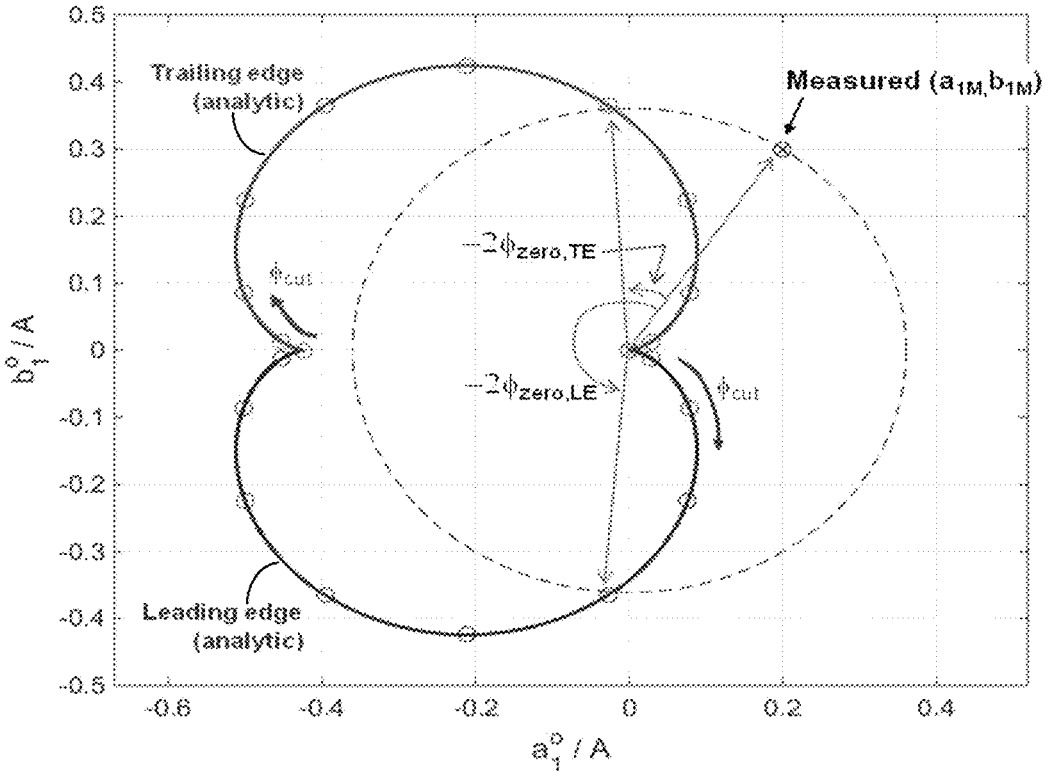
FIG. 6 illustrates a geometrical interpretation of the above inversion concepts, according to an embodiment.

FIG. 6 illustrates a geometrical interpretation of the above inversion concepts, according to an embodiment. The blue and red curves are parametric curves of $(a_1^o,b_1^o)/a_0$ with $\varphi_{cut}$ as the parameter. As can be seen, the lower curve corresponds to leading edge; $\varphi_{cut}=0$ is at (0,0) and continues to the right and downward for increasing $\varphi_{cut}$, as shown. The upper curve corresponds to trailing edge; $\varphi_{cut}=0$ is at $(-4/3\pi,0)$ and continues to the left and upward for increasing $\varphi_{cut}$. The circles on each curve are at equal intervals of $\Delta\varphi_{cut}=\pi/10$. These curves correspond to $\varphi_{zero}=0$. For arbitrary $\varphi_{zero}$, which at this point is unknown, they rotate about the origin by the angle $2\varphi_{zero}$ In determining $\varphi_{zero}$ one considers the measured value (an example is shown) and rotates it until it intersects the appropriate analytic curve. The rotation angle is $-2\varphi_{zero}$.

Leading Versus Trailing Edge

The dimming control algorithm 203 can be configured to determine the phase cut dimmer type (leading edge or trailing edge), in accordance with some embodiments. Since the dimmer type does not change while the lamp is operating (typically), it is sufficient to determine the type once, for example during start-up. As previously explained, the algorithm 203 presumes knowledge of the frequency of the input mains waveform, and the dimmer type determination can be carried out by evaluating one cycle of that (full wave rectified) waveform. If desired, it can perform the same operation on many successive cycles in order to reduce the probability of error.

Figure 7A:
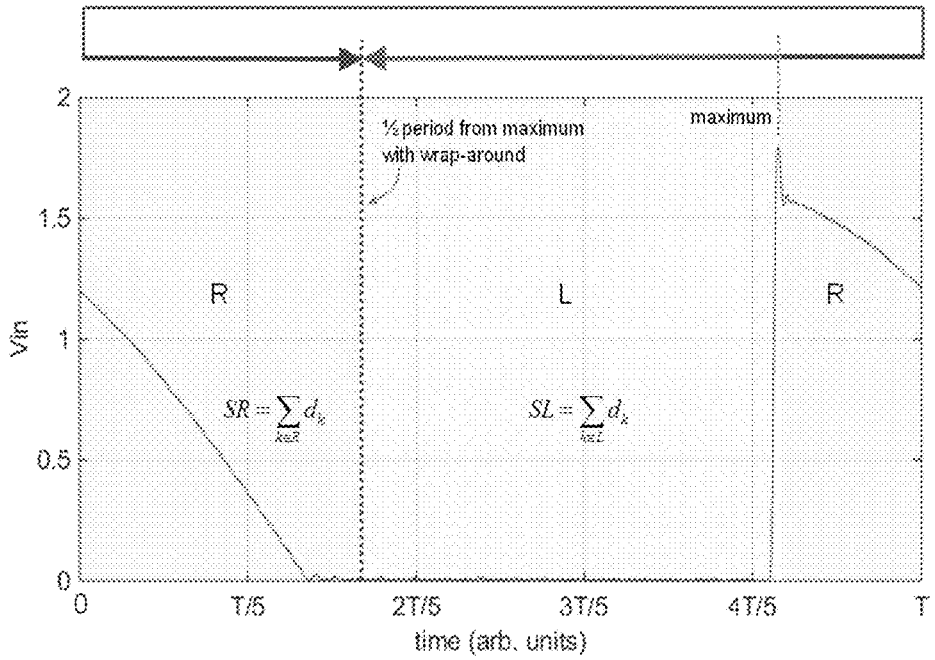
FIG. 7*a* graphically illustrates a methodology for determining dimmer type according to an example embodiment of the present disclosure.
Figure 7B:
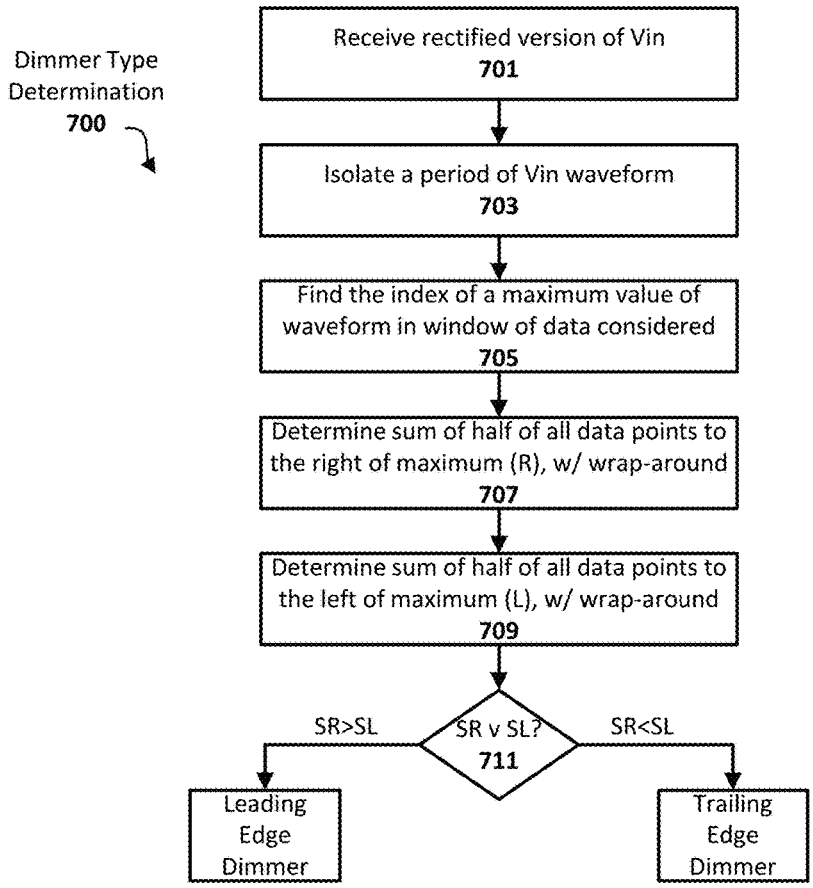
FIG. 7*b* illustrates a flow chart of that methodology.

The methodology for determining dimmer type according to one example embodiment is pictorially shown in FIG. 7*a*, and is further demonstrated by the flowchart of FIG. 7*b*. As can be seen, the method 700 commences with receiving 701 the full wave rectified version of Vin, and isolating or otherwise acquiring 703 one cycle of the full wave rectified waveform (i.e., period T). The data representing the acquired signal period can be stored, for example, in a local non-volatile memory. As with the dimming control algorithm 203 invoked during steady-state, if the sample frequency is not an integer multiple of the waveform frequency, then the methodology 700 may be further configured to consider a number of data points that is closest to one cycle (the efficacy of the methodology does not suffer by this). The method 700 continues with finding 705 the index of the maximum value of the waveform in the window of data considered (i.e., do not consider the peak value of the non-phase cut waveform if the phase cut angle is such that the peak is not present). If there is noise on the signal and if the phase cut angle is small (leading edge) or large (trailing edge), then it is best to find the maximum of a boxcar averaged version of the signal. Note that there may be a fluctuation in the waveform at the instance of turn-on (e.g., this is seen in FIGS. 5*a*-*b*). It is worth noting here that such fluctuations do not diminish the algorithm's success.

The dimmer type determination method 700 continues with determining 707 the sum of half of all data points to the right of the maximum, with wrap-around (these are the data points in the regions labeled a' in FIG. 7*a*). Let this value be SR. The method 700 further continues with determining 709 the sum of half of all data points to the left of the maximum, with wrap-around (these are the data points in the regions labeled 'L' in FIG. 7*a*). Let this value be SL. The method then continues with comparing 711 SR to SL to determine the dimmer type. In particular, if SR>SL, then the waveform is leading edge (and therefore the dimmer is a leading edge dimmer). On the other hand, if SR<SL then the waveform is trailing edge (and therefore the dimmer is a trailing edge dimmer). In the case of no dimmer being detected (for whatever reason), then the dimming control algorithm 203 need not be invoked (i.e., no bleeder current) and current control PWM duty cycle can be set to maximum.

Thus, a dimmable LED controller configured with a dimming control algorithm 203 can be used to provide for superior performance of lamps operating on phase cut dimmers, both leading edge and trailing edge. The dimming control algorithm 203 is very robust with respect to noise, fluctuations, distortions and other non-ideal characteristics of the mains waveform, as will be appreciated in light of this disclosure.

Determining $\cos(\varphi_{cut})$ for the Full-Inversion Approach

A mathematical method can be used provided for obtaining $\varphi_{cut}$, without the need for knowledge of the amplitude A or of $\varphi_{zero}$ The method generally includes finding an equation that contains $\varphi_{cut}$, but not the other two unknowns, $\varphi_{zero}$ and A. A starting point is Equation (11), where the left-hand-side quantities are considered to be the experimental values and the right-hand side are the analytical forms from (7) and (8). Equation (11) is a consequence of the fact that the amplitude of the Fourier coefficients (all harmonics) is independent of the phase, $\varphi_{zero}$, of the waveform. Thus, Equation (11) does not contain $\varphi_{zero}$ However, it does contain A; $A^2$ is a multiplicative factor in both terms on the right-hand-side. Thus, A can be eliminated by dividing right-hand-side by $(a_0)^2$, which also contains $A^2$ as a multiplicative factor. Then the left-hand side can be divided by its experimental counterpart $(a_{0M})^2$. Then, taking the square root of both sides yields:

$$\frac{\sqrt{(a_{1M})^2 + (b_{1M})^2}}{a_{0M}} = \frac{\sqrt{(a_1^o)^2 + (b_1^o)^2}}{a_0} \tag{24}$$

or $$M = \frac{1}{6} \cdot \frac{\sqrt{[-2 \mp 3\cos(\phi_{cut}) \pm \cos(3\phi_{cut})]^2 + [\mp 3\sin(\phi_{cut}) \pm \sin(3\phi_{cut})]^2}}{[1 \pm \cos(\phi_{cut})]} \tag{25}$$

where M is the experimental quantity given by the left-hand-side of Equation (24). Upper signs are for leading edge, lower signs for trailing edge waveforms.

Figure 8:
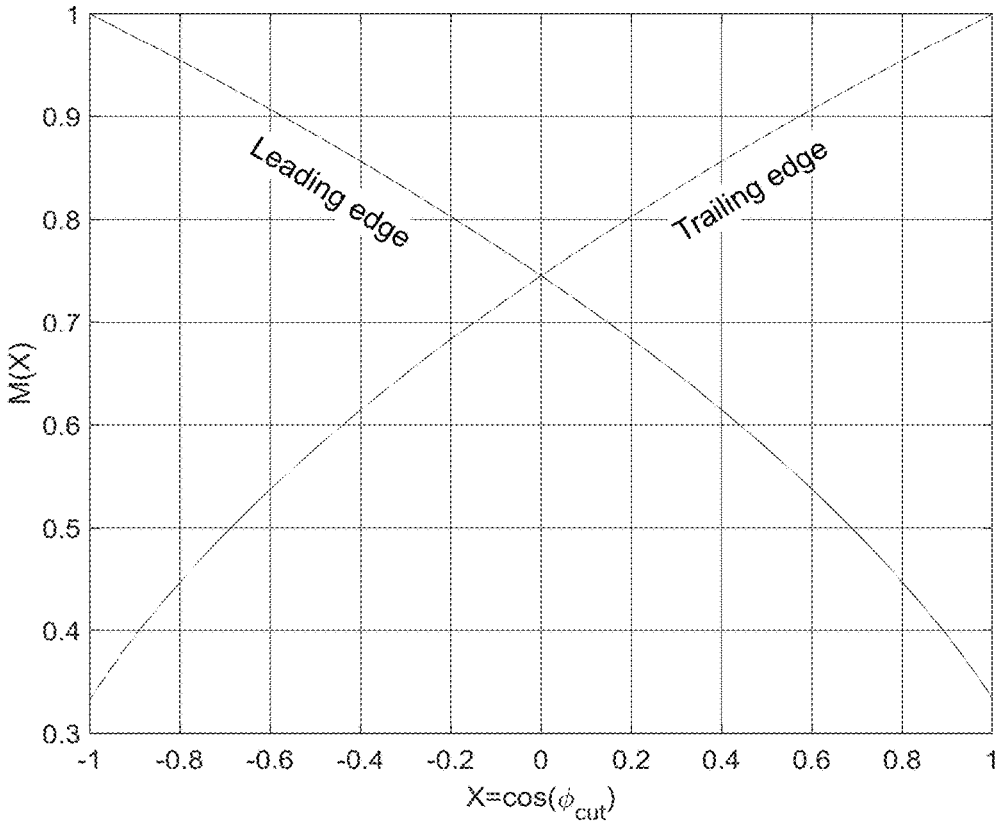
FIG. 8 illustrates plots of a function $M(\varphi_{cut})$ versus $\varphi_{cut}/\pi$ for leading edge and trailing edge waveforms.

Equation (25) is a function only of the unknown $\varphi_{cut}$. Alternatively, it can also be expressed as a function of the single unknown $X=\cos(\varphi_{cut})$, with suitable substitutions of Equations 16, 17, and 18. It is advantageous to consider it in this form because it provides for better noise performance of the algorithm. The complicated form of M(X) renders it unsolvable (for X) analytically, but it is "solvable" in straightforward fashion numerically. The function on the right-hand-side of the equation is plotted in FIG. 8. In more detail, FIG. 8 illustrates plots of the function M(X) Equation (25) versus X for leading edge and trailing edge waveforms. Since the right-hand-side of the Equation (25) is a monotonically decreasing function (leading edge) or increasing function (trailing edge) of X, it is straightforward to obtain X by numerical inversion by minimization of the absolute value of the difference of the right-hand and left-hand sides. In the full-inversion approach, experimental values of M are calculated from measurements, and then X is determined from the numerically inverted function, X(M). In implementing in an actual lighting driver, note that the numerical inversion need not be performed in real-time. Instead, discrete values of X(M) could be determined offline and stored, for example, in an array in the firmware of the controller 115 or in some suitable non-volatile memory accessible to the controller 115. In any such cases, the array can be loaded at start-up of the lamp. During each cycle, values of X are then found for any (measured) value of M by interpolation using a pre-computed look-up table or other database of known data that will allow such an interpolation to be carried out.

Computer Simulations of Dimming Control Algorithm

A computer-based simulation program was written to validate the dimming control algorithm and test its sensitivities to noise and distortions on the mains input waveform, and to variations of the presumed-known physical parameters (primarily, waveform frequency and mains amplitude) from their assumed values. The program was written using Matlab, running on a standard PC, but any number of suitable other simulation environments can be used. Parameters related to data acquisition were also included (e.g., # bits, sampling rate, dynamic range).

In running the dimming control simulation program, the input waveform properties and measurement and ADC properties listed in Table 1 can be specified.

TABLE 1

Example Input parameters for dimming control simulation program.

| Waveform properties | Measurement & ADC properties |
|---|---|
| frequency, amplitude, baseline, phase at t = 0, noise (standard deviation of added Gaussian noise), dimmer type (leading/trailing edge), phase cut angle, delta time for turn-on (or off) (waveform linearly changes from on to off state or vice- versa), number of cycles to consider. | Sampling frequency, number of bits, minimum level of detection, maximum level of detection (same units as waveform amplitude), assumed amplitude of input waveform, number of Fourier harmonics to consider in algorithm, inversion approach (full/reduced). |

The program steps through time, one sample period for each step. The first step is considered to start at t=0. A counter is initialized to zero for the first step and is incremented at each subsequent step. The program determines how many counts (N) in one period. If the waveform frequency is not an integer multiple of the sampling frequency, then this number is rounded to the nearest integer. For each step the program creates the "real" (simulated) voltage of the waveform at the specific point in time, adds Gaussian noise using a random number generator, and then simulates the acquisition of this voltage using the specified min/max levels and #bits of the ADC.

For counter<N−1 the program calculates the values of the running sums ($d_k$, $d_k \cos(2\pi k/N)$, and $d_k \sin(2\pi k/N$, as discussed with reference to Equation (14)). When counter=N the inversion algorithm, as described in the previous subsection, is invoked and the counter is set to 0. This continues for the desired number of cycles, $N_c$. Thus, $N_c$ values of $\varphi_{cut}$ and $\varphi_{zero}$ are determined. If there is Gaussian noise added to the signal, or if the waveform frequency is not an integer multiple of the sampling period then the $N_c$ values of $\varphi_{cut}$ and $\varphi_{zero}$ in general fluctuate, otherwise all values calculated for all cycles are the same. Average and standard deviations of the values of $\varphi_{cut}$ and $\varphi_{zero}$ are generated and compared to the "real" values.

Figure 9A:
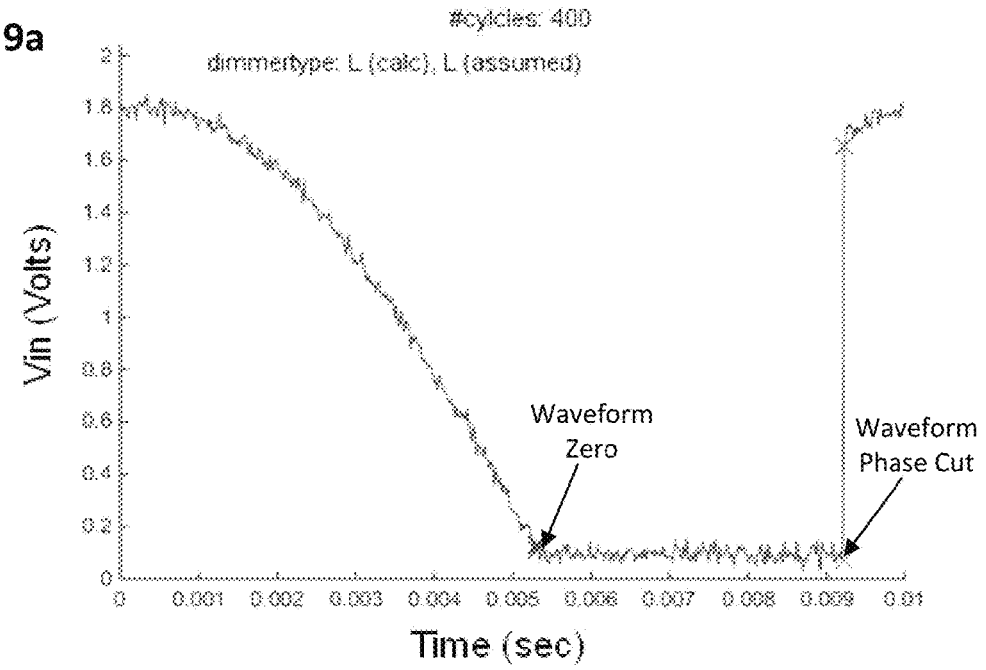
FIGS. 9*a* and 9*b* show results from an example dimming control simulation program configured in accordance with an embodiment of the present disclosure.
Figure 9B:
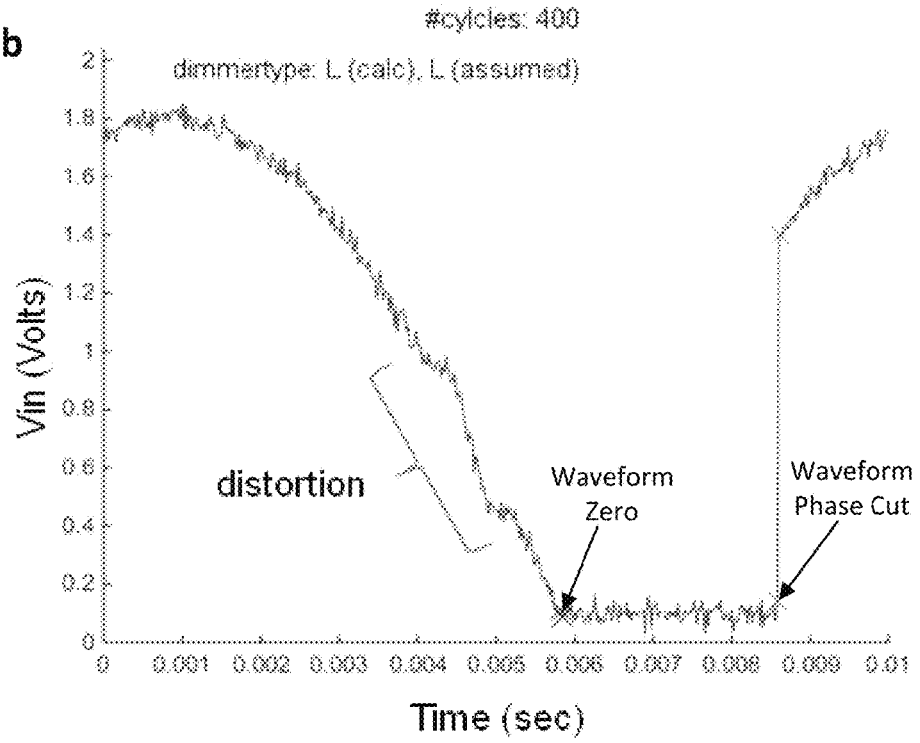

FIGS. 9*a* and 9*b* show results from an example simulation. The simulation results correspond to the pure sinusoidal waveform (with added noise) shown in FIG. 9*a*. The parameters used for the simulation are given in Table 2. The measurement parameters are the same as those in implemented in an actual driver. In this situation the values of $\varphi_{cut}$ and $\varphi_{zero}$ fluctuate because of added Gaussian noise (0.025 standard deviation) superimposed on the waveform. The noise is 68 times smaller than the waveform amplitude of 1.7. The standard deviation was chosen because it is on the order of what is typically observed in some drivers. It is seen (FIG. 11, lower two plots) that there is a standard deviation of 0.13 degrees for $\varphi_{cut}$ and 0.084 degrees for $\varphi_{zero}$ This is acceptable for an actual driver.

TABLE 2

Parameters used for simulation.

| | | | |
|---|---|---|---|
| Waveform frequency (two considered) | 100 Hz<br>120 Hz | Sample frequency | $50 \times 10^3$ sec$^{-1}$ |
| Waveform amplitude | 1.7 | #bits | 10 |
| Waveform baseline | 0.1 | Min detection level | 0 |
| Standard dev. noise | 0.025 | Max detection level | 3.3 |
| Dimmer type | leading | #cycles | 400 |
| $\varphi_{cut}$ | 70 deg | harmonics calculated | 1, 2, 3 |
| Δt turn-on | instant | Inversion approach | Reduced |

The same simulation was done using the distorted waveform FIG. 9*b*. The simulation results were practically identical to those of the pure sinusoidal waveform in FIG. 9*a*. In other words, any deviation of behavior of the lamp would not be expected to be caused by erroneous determination of waveform zero or phase cut angles. The plot of FIG. 9*a* shows the $400^{th}$ (final) cycle of the simulation. Note the time in the window of the waveform zero, as well as the time in the window of the phase cut. There are multiple 'x' marking each location because the simulation calculates using harmonics 1, 2, and 3. FIG. 9*b* is the same, except with the distortion added.

Figure 10A:
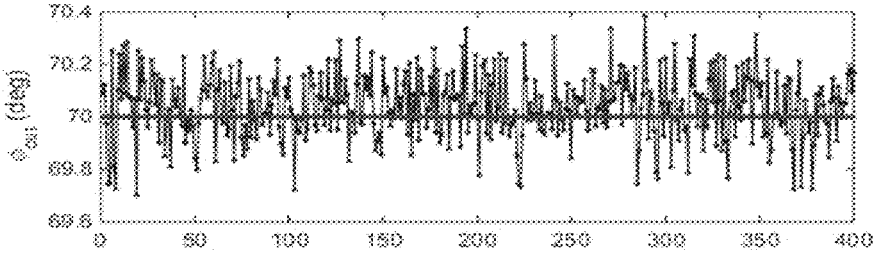
FIGS. 10*a-d* illustrate the sample simulation using the parameters listed in Table 2 (no distortion).
Figure 10B:
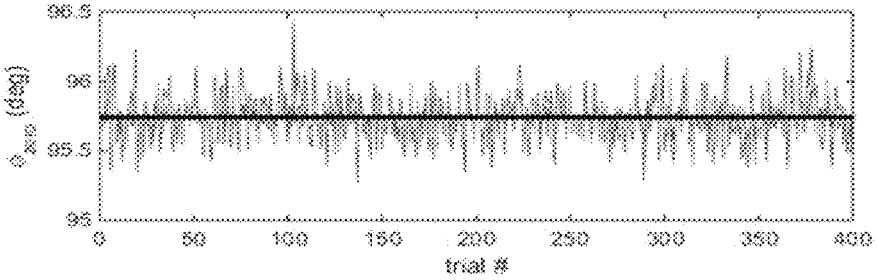
Figure 10C:
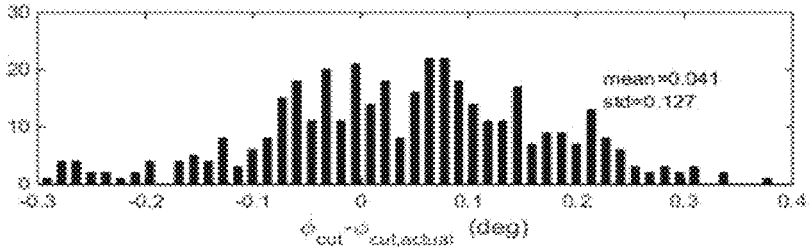
Figure 10D:
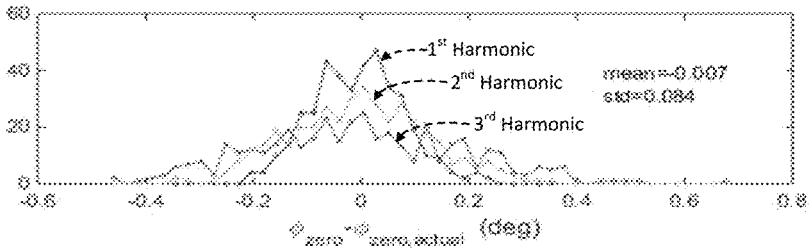

FIGS. 10*a-d* illustrate the sample simulation using the parameters listed in Table 2 (no distortion). These plots show information from all 400 cycles considered. Upper two plots (FIGS. 10*a* and 10*b*, respectively) show $\varphi_{cut}$ and $\varphi_{zero}$, both results from simulation (noisy lines) and input values (constant lines). Bottom two plots (FIGS. 10*c* and 10*d*, respectively) show histograms of the differences of the simulation values and the input values of $\varphi_{cut}$ and $\varphi_{zero}$ Shown are values calculated using the first three harmonics, as indicated in FIG. 10*d*.

Figure 11:
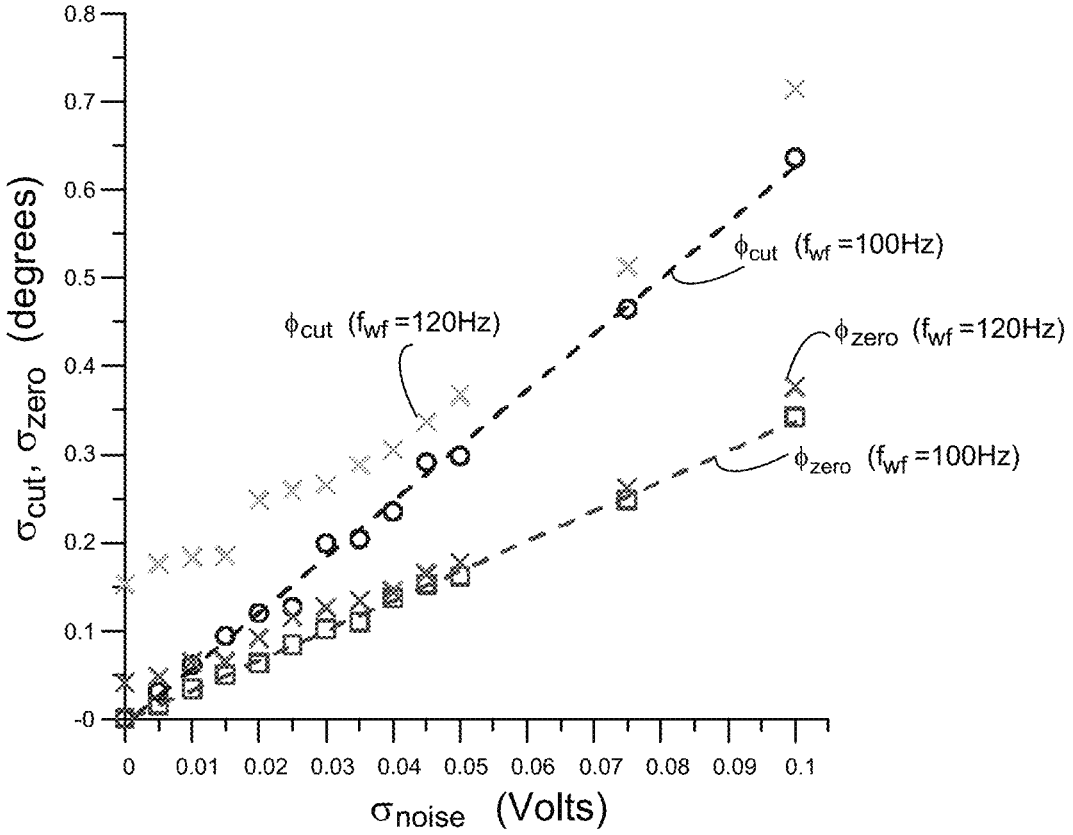
FIG. 11 shows plots of deviations of $\varphi_{cut}$ and $\varphi_{zero}$ versus added noise on the input waveform.

FIG. 11 shows plots of deviations of $\varphi_{cut}$ and $\varphi_{zero}$ versus added noise on the input waveform. Otherwise, parameters in Table 2 were used. As can be seen, two sets of two plots are shown. One set corresponds to 100 Hz input waveform and the other set corresponds to 120 Hz waveform. In both cases, sample rate was 50 kSPS. In the latter case, since the waveform frequency is not an integer multiple of the sample rate, the standard deviations (or uncertainties) in $\varphi_{cut}$ and $\varphi_{zero}$ do not go to zero as noise in the waveform goes to zero. The waveform shifts in phase a small amount for each window.

Numerous embodiments will be apparent in light of this disclosure. One example embodiment provides a method for control of a phase cut dimmer for lighting systems. The method includes: receiving a representation of an input voltage waveform having a phase cut angle ($\varphi_{cut}$) and a waveform zero angle ($\varphi_{zero}$), as well as a known frequency; acquiring data representative of a period of the waveform; determining a plurality of Fourier series coefficients associated with the waveform; and extracting the phase cut angle ($\varphi_{cut}$) and the waveform zero angle ($\varphi_{zero}$) based on the coefficients. In some cases, determining a plurality of Fourier series coefficients associated with the period comprises determining the two lowest order Fourier series coefficients ($0^{th}$ and $1^{st}$) associated with the waveform. In some cases, the method further includes storing the data representative of the waveform period. In some cases, acquiring data representative of a period of the waveform comprise acquiring data representative of one period of the waveform. In some cases, extracting the phase cut angle ($\varphi_{cut}$) and the waveform zero angle ($\varphi_{zero}$) based on the coefficients comprises extracting the phase cut angle ($\varphi_{cut}$) and the waveform zero angle ($\varphi_{zero}$) through inversion of an analytical representation of the coefficients, the inversion comprising: determining the values of $\cos(\varphi_{cut})$ and $\sin(\varphi_{cut})$; and determining the value of the waveform zero angle $\varphi_{zero}$ based on $\cos(\varphi_{cut})$ and $\sin(\varphi_{cut})$. In some cases, determining the values of $\cos(\varphi_{cut})$ and $\sin(\varphi_{cut})$ is carried out using the follow equations:

$$\cos(\phi_{cut}) = \pm\left(\frac{\pi a_{0M}}{2A} - 1\right);$$

and, $\sin(\varphi_{cut})=\sqrt{1-\cos^2(\varphi_{cut})}$, where A is amplitude of the input waveform, $\pi$ is the period of the waveform, and $$a_{0M} = \frac{2}{N}\sum_{k=1}^{N} d_k,$$

where N is a number of data points include in the data representative of the period, $d_k$ is the $k^{th}$ data point of the N data points, M indicates $a_0$ is a measured valued, and the upper + sign of the ± symbol corresponds to leading edge phase cut waveforms and lower − sign of the ± symbol corresponds to trailing edge phase cut waveforms. In some such cases, A is assumed based on a nominal RMS (root mean square) level of the waveform together with a division factor based on resistance values of resistors used in a voltage divider to generate the representation of an input voltage waveform. In some cases, determining the value of $\cos(\varphi_{cut})$ is carried out using interpolation, and determining the value of $\sin(\varphi_{cut})$ is carried out using the follow equation $\sin(\varphi_{cut})=\sqrt{1-\cos^1(\varphi_{cut})}$. In some such cases, the interpolation is carried out by accessing a pre-computed look-up table (LUT). Another embodiment provides a non-transitory computer program product encoding instructions that when executed by one or more processors cause a dimming control process for a light system to be carried out, the process including the methodology as variously described in this paragraph. The non-transitory computer program product may include, for example, one or more machine readable mediums, such as a hard disk, ROM, solid state drive, thumb drive, embedded controller memory, compact disc, server computer, or other such non-transitory mediums that can be accessed by one or more processors so that the instructions thereon can be executed to carry out the process. Another example embodiment provides a lighting driver controller. The controller includes: a processor, and a memory accessible to the processor and encoding a plurality of instructions that when executed by the processor cause a dimming control process to be carried out, the process including the methodology as variously described in this paragraph. Note that the process so encoded on the computer program product or memory of the lighting driver controller need not be carried out, and may remain unexecuted in some such embodiments.

The foregoing description of the various embodiments has been presented for the purposes of illustration and description. It is not intended to be exhaustive or to limit the present disclosure to the precise form disclosed. Many modifications and variations are possible in light of this disclosure. It is intended that the scope of this disclosure be limited not by this detailed description, but rather by the claims appended hereto.

What is claimed is:

1. A method for control of a phase cut dimmer for lighting systems, the method comprising:

receiving, at a controller of a lighting driver circuit, a representation of an input voltage waveform having a phase cut angle ($\varphi_{cut}$) and a waveform zero angle ($\varphi_{zero}$), as well as a known frequency;

acquiring, by the controller, data representative of a period of the waveform;

determining, by the controller, a plurality of Fourier series coefficients associated with the waveform;

extracting, by the controller, the phase cut angle ($\varphi_{cut}$) and the waveform zero angle ($\varphi_{zero}$) based on the coefficients;

determining, by the controller, a current for one or more light emitting diodes (LEDs) based on at least one of the phase cut angle ($\varphi_{cut}$) and the waveform zero angle ($\varphi_{zero}$); and adjusting, by the controller, a duty cycle of a pulse width modulation (PWM) signal to provide the determined current to the one or more LEDs.

2. The method of claim 1 wherein determining a plurality of Fourier series coefficients associated with the period comprises determining the two lowest order Fourier series coefficients ($0^{th}$ and $1^{st}$) associated with the waveform.

3. The method of claim 1, further comprising:

storing the data representative of the waveform period.

4. The method of claim 1 wherein acquiring data representative of a period of the waveform comprise acquiring data representative of one period of the waveform.

5. The method of claim 1 wherein extracting the phase cut angle ($\varphi_{cut}$) and the waveform zero angle ($\varphi_{zero}$) based on the coefficients comprises extracting the phase cut angle ($\varphi_{cut}$) and the waveform zero angle ($\varphi_{zero}$) through inversion of an analytical representation of the coefficients, the inversion comprising:

determining the values of $\cos(\varphi_{cut})$ and $\sin(\varphi_{cut})$; and determining the value of the waveform zero angle $\varphi_{zero}$ based on $\cos(\varphi_{cut})$ and $\sin(\varphi_{cut})$.

6. The method of claim 5 wherein determining the values of $\cos(\varphi_{cut})$ and $\sin(\varphi_{cut})$ is carried out using the follow equations:

$$\cos(\phi_{cut}) = \pm\left(\frac{\pi a_{oM}}{2A} - 1\right); \text{ and}$$

$$\sin(\phi_{cut}) = \sqrt{1 - \cos^2(\phi_{cut})},$$

where A is amplitude of the input waveform, $\pi$ is the period of the waveform, and $$a_{0M} = \frac{2}{N}\sum_{k=1}^{N} d_k,$$

where N is a number of data points include in the data representative of the period, $d_k$ is the $k^{th}$ data point of the N data points, M indicates $a_0$ is a measured valued, and the upper + sign of the ± symbol corresponds to leading edge phase cut waveforms and lower − sign of the ± symbol corresponds to trailing edge phase cut waveforms.

7. The method of claim 6 wherein A is assumed based on a nominal RMS (root mean square) level of the waveform together with a division factor based on resistance values of resistors used in a voltage divider to generate the representation of an input voltage waveform.

8. The method of claim 1 wherein determining the value of $\cos(\varphi_{cut})$ is carried out using interpolation, and determining the value of $\sin(\varphi_{cut})$ is carried out using the follow equation $\sin(\varphi_{cut})=\sqrt{1-\cos^2(\varphi_{cut})}$.

9. The method of claim 8 wherein the interpolation is carried out by accessing a pre-computed look-up table (LUT).

10. A non-transitory computer program product encoding instructions that when executed by one or more processors cause a dimming control process for a light system to be carried out, the process comprising:

receiving, at a controller of a lighting driver circuit, a representation of an input voltage waveform having a phase cut angle ($\varphi_{cut}$) and a waveform zero angle ($\varphi_{zero}$), as well as a known frequency;

acquiring, by the controller, data representative of a period of the waveform;

determining, by the controller, a plurality of Fourier series coefficients associated with the waveform;

extracting, by the controller, the phase cut angle ($\varphi_{cut}$) and the waveform zero angle ($\varphi_{zero}$) based on the coefficients;

determining, by the controller, a current for one or more light emitting diodes (LEDs) based on at least one of the phase cut angle ($\varphi_{cut}$) and the waveform zero angle ($\varphi_{zero}$); and adjusting, by the controller, a duty cycle of a pulse width modulation (PWM) signal to provide the determined current to the one or more LEDs.

11. The computer program product of claim 10 wherein determining a plurality of Fourier series coefficients associated with the period comprises determining the two lowest order Fourier series coefficients ($0^{th}$ and $1^{st}$) associated with waveform.

12. The computer program product of claim 10, further comprising:

storing the data representative of the waveform period.

13. The computer program product of claim 10 wherein acquiring data representative of a period of the waveform comprises acquiring data representative of one period of the waveform.

14. The computer program product of claim 10 wherein extracting the phase cut angle ($\varphi_{cut}$) and the waveform zero angle ($\varphi_{zero}$) based on the coefficients comprises extracting the phase cut angle ($\varphi_{cut}$) and the waveform zero angle ($\varphi_{zero}$) through inversion of an analytical representation of the coefficients, the inversion comprising:

determining the values of $\cos(\varphi_{cut})$ and $\sin(\varphi_{cut})$; and determining the value of the waveform zero angle $\varphi_{zero}$ based on $\cos(\varphi_{cut})$ and $\sin(\varphi_{cut})$.

15. The computer program product of claim 10 wherein determining the values of $\cos(\varphi_{cut})$ and $\sin(\varphi_{cut})$ is carried out using the follow equations:

$$\cos(\phi_{cut}) = \pm\left(\frac{\pi a_{oM}}{2A} - 1\right); \text{ and}$$

$$\sin(\phi_{cut}) = \sqrt{1 - \cos^2(\phi_{cut})},$$

where A is amplitude of the input waveform, $\pi$ is the period of the waveform, and $$a_{0M} = \frac{2}{N}\sum_{k=1}^{N} d_k,$$

where N is a number of data points include in the data representative of the period, $d_k$ is the $k^{th}$ data point of the N data points, M indicates $a_0$ is a measured valued, and the upper + sign of the ± symbol corresponds to leading edge phase cut waveforms and lower − sign of the ± symbol corresponds to trailing edge phase cut waveforms.

16. The computer program product of claim 15 wherein A is assumed based on a nominal RMS (root mean square)

level of the waveform together with a division factor based on resistance values of resistors used in a voltage divider to generate the representation of an input voltage waveform.

17. The computer program product of claim 10 wherein determining the value of $\cos(\varphi_{cut})$ is carried out using interpolation, and determining the value of $\sin(\varphi_{cut})$ is carried out using the follow equation $\sin(\varphi_{cut})=\sqrt{1-\cos^2(\varphi_{cut})}$.

18. The computer program product of claim 17 wherein the interpolation is carried out by accessing a pre-computed look-up table (LUT).

19. A lighting driver controller, comprising:

a processor;

a memory accessible to the processor and encoding a plurality of instructions that when executed by the processor cause a dimming control process to be carried out, the process comprising:

receiving a representation of an input voltage waveform having a phase cut angle ($\varphi_{cut}$) and a waveform zero angle ($\varphi_{zero}$), as well as a known frequency;

acquiring data representative of a period of the waveform;

determining a plurality of Fourier series coefficients associated with the waveform;

extracting the phase cut angle ($\varphi_{cut}$) and the waveform zero angle ($\varphi_{zero}$) based on the coefficients;

determining a current for one or more light emitting diodes (LEDs) based on at least one of the phase cut angle ($\varphi_{cut}$) and the waveform zero angle ($\varphi_{zero}$); and adjusting a duty cycle of a pulse width modulation (PWM) signal to provide the determined current to the one or more LEDs.

20. The controller of claim 19 wherein determining a plurality of Fourier series coefficients associated with the period comprises determining the two lowest order Fourier series coefficients ($0^{th}$ and $1^{st}$) associated with the waveform.

21. The controller of claim 19, further comprising:

storing the data representative of the waveform period.

22. The controller of claim 19 wherein acquiring data representative of a period of the waveform comprise acquiring data representative of one period of the waveform.

23. The controller of claim 19 wherein extracting the phase cut angle ($\varphi_{cut}$) and the waveform zero angle ($\varphi_{zero}$) based on the coefficients comprises extracting the phase cut angle ($\varphi_{cut}$) and the waveform zero angle ($\varphi_{zero}$) through inversion of an analytical representation of the coefficients, the inversion comprising:

determining the values of $\cos(\varphi_{cut})$ and $\sin(\varphi_{cut})$; and determining the value of the waveform zero angle $\varphi_{zero}$ based on $\cos(\varphi_{cut})$ and $\sin(\varphi_{cut})$.

24. The controller of claim 19 wherein determining the values of $\cos(\varphi_{cut})$ and $\sin(\varphi_{cut})$ is carried out using the follow equations:

$$\cos(\phi_{cut}) = \pm\left(\frac{\pi a_{oM}}{2A} - 1\right); \text{ and}$$

$$\sin(\phi_{cut}) = \sqrt{1-\cos^2(\phi_{cut})},$$

where A is amplitude of the input waveform, $\pi$ is the period of the waveform, and $$a_{0M} = \frac{2}{N}\sum_{k=1}^{N} d_k,$$

where N is a number of data points include in the data representative of the period, $d_k$ is the $k^{th}$ data point of the N data points, M indicates $a_0$ is a measured valued, and the upper + sign of the ± symbol corresponds to leading edge phase cut waveforms and lower − sign of the ± symbol corresponds to trailing edge phase cut waveforms.

25. The controller of claim 24 wherein A is assumed based on a nominal RMS (root mean square) level of the waveform together with a division factor based on resistance values of resistors used in a voltage divider to generate the representation of an input voltage waveform.

26. The controller of claim 19 wherein determining the value of $\cos(\varphi_{cut})$ is carried out using interpolation, and determining the value of $\sin(\varphi_{cut})$ is carried out using the follow equation $\sin(\varphi_{cut})=\sqrt{1-\cos^2(\varphi_{cut})}$.

27. The controller of claim 26 wherein the interpolation is carried out by accessing a pre-computed look-up table (LUT).

* * * * *